US011420840B2

(12) United States Patent
Haug

(10) Patent No.: US 11,420,840 B2
(45) Date of Patent: Aug. 23, 2022

(54) METHOD FOR FRANKING PACKAGES INDIVIDUALLY SUPPLIED FROM A STACK BY A FRANKING MACHINE

(71) Applicant: FRAMA AG, Lauperswil (CH)

(72) Inventor: Thomas Peter Haug, Bern (CH)

(73) Assignee: FRAMA AG, Lauperswil (CH)

( * ) Notice: Subject to any disclaimer, the term of this patent is extended or adjusted under 35 U.S.C. 154(b) by 530 days.

(21) Appl. No.: 16/567,826

(22) Filed: Sep. 11, 2019

(65) Prior Publication Data

US 2020/0079126 A1 Mar. 12, 2020

(30) Foreign Application Priority Data

Sep. 11, 2018 (EP) ..... 18405019

(51) Int. Cl.
*B65H 29/58* (2006.01)
*B41L 45/06* (2006.01)
(Continued)

(52) U.S. Cl.
CPC ..... *B65H 29/58* (2013.01); *B41L 45/06* (2013.01); *B41L 47/24* (2013.01); *B65H 3/063* (2013.01);
(Continued)

(58) Field of Classification Search
CPC ..... B65H 1/06; B65H 3/063; B65H 5/062; B65H 5/36; B65H 5/38; B65H 29/12; B65H 29/14; B65H 29/58; B65H 29/60; B65H 2403/942; B65H 2404/61; B65H 2404/6112; B65H 2404/63; B65H 2404/632; B65H 2404/65; B65H 2404/651; B65H 2404/7414; B65H 2405/3321; B65H 2701/1916; B65H 2801/78; G07B 17/00467; G07B 17/00508; G07B 2017/00491
See application file for complete search history.

(56) References Cited

U.S. PATENT DOCUMENTS 4,893,249 A 1/1990 Silverberg
5,762,431 A * 6/1998 Pawelka ..... B41J 13/12 271/902

(Continued)

FOREIGN PATENT DOCUMENTS

EP 17405029 A1 5/2019
EP 17405030 A1 5/2019
EP 17405031 A1 5/2019

*Primary Examiner* — Prasad V Gokhale
(74) *Attorney, Agent, or Firm* — Lucas & Mercanti, LLP; Klaus P. Stoffel

(57) ABSTRACT

A method for franking packages individually supplied from a stack on a conveyor line to a franking machine, such as envelopes, mailing bags, sleeves, cards, labels, printed products, or the like, which are removed at the lower side of the stack for separation and which are supplied on the upstream conveyor line to a printing mechanism of the franking machine and which, after printing of the packages, are discharged from the franking machine. The packages are supplied on the conveyor portion via a switch to the franking machine and after printing are supplied counter to the supply direction from the printing mechanism of the franking machine via the transposed switch of a depositing device which is provided therebelow for printed packages.

15 Claims, 4 Drawing Sheets

(51) Int. Cl.

| | |
|---|---|
| ***B41L 47/24*** | (2006.01) |
| ***B65H 3/06*** | (2006.01) |
| ***B65H 29/14*** | (2006.01) |
| ***G07B 17/00*** | (2006.01) |
| ***B65H 5/36*** | (2006.01) |

(52) U.S. Cl.

CPC ..... *B65H 5/36* (2013.01); *B65H 29/14* (2013.01); *G07B 17/00508* (2013.01); *B65H 2404/6112* (2013.01); *B65H 2404/63* (2013.01); *B65H 2701/1916* (2013.01); *B65H 2801/78* (2013.01); *G07B 2017/0062* (2013.01); *G07B 2017/00491* (2013.01)

(56) References Cited

U.S. PATENT DOCUMENTS

| | | | | |
|---|---|---|---|---|
| 2014/0145396 | A1* | 5/2014 | Hiyama ..... | G06K 13/12 271/225 |
| 2019/0009583 | A1* | 1/2019 | Moreira ..... | B65H 1/12 |
| 2019/0152728 | A1 | 5/2019 | Haug | |
| 2019/0152731 | A1 | 5/2019 | Haug | |
| 2019/0152732 | A1 | 5/2019 | Haug | |

* cited by examiner

METHOD FOR FRANKING PACKAGES INDIVIDUALLY SUPPLIED FROM A STACK BY A FRANKING MACHINE

CROSS-REFERENCE TO RELATED APPLICATIONS

The present application claims priority of EP 18 405 019.3, filed Sep. 11, 2018, the priority of this application is hereby claimed and this application is incorporated herein by reference.

BACKGROUND OF THE INVENTION

The invention relates to a method for franking packages individually supplied from a stack on a conveyor line to a franking machine, such as envelopes, mailing bags, sleeves, cards, labels, printed products, or the like, which are removed at the lower side of a stack for separation and which are supplied on an upstream conveyor line to a printing mechanism of the franking machine and which, after printing of the packages, are discharged from the franking machine.

Sleeves are intended to be understood to be inter alia closable bags of (semi) card for flat, in particular thin, products such as, for example, printed products, CDs or other items of a similar format.

The packages may of course be individually presented manually via a feeding device.

Devices of the type described in the introduction are described in the European patent applications EP 17 405 029, EP 17 405 030 and EP 17 405 031, wherein EP 17 405 029 relates to a device for franking individual flat packages which are removed at the lower side of a stack and which are guided in a transport direction on a side edge and which are transported or transported onward on a processing line between a feeder and a separation device in a cyclical manner.

In EP 17 405 030 packages are separated in a device and transported onward in a cyclical manner for franking.

EP 17 405 031 sets out a device for printing packages which are supplied individually from a printing mechanism of a franking machine and which on at least one flat side pass the printing mechanism of the franking machine in a manner driven in a frictionally engaging manner.

SUMMARY OF THE INVENTION

Based on knowledge of the prior art, the objective is to provide a method and a device produced accordingly for processing packages which as a result of a simple method and simple construction means functions in a reliable manner and can be produced under favorable conditions.

According to the invention the object was achieved in that the packages are supplied on the conveyor portion via a switch to the franking machine and after printing are returned counter to the supply direction from the printing mechanism of the franking machine via the transposed switch to a depositing device which is provided therebelow for printed packages.

In the print processing industry, a depositing device may also be referred to as a shelf.

With this procedure, a simplified processing and undisturbed transfer of the packages into the franking machine to the greatest possible extent and return in the opposite direction with the switch transposed into a depositing device, also referred to as a shelf, can be achieved.

This method allows a simpler and more compact construction of the device than before.

A cyclical processing of the packages consequently promotes control and reliability.

Advantageously, the actuation of the switch or the switch position when packages are supplied is carried out with the timing of the printing sequence of the printing mechanism of the franking machine so that an undisturbed start-up of production can be produced.

Preferably, there is provided to transpose the switch an independent switch tongue which controls the supply of the packages to the franking machine and the return of the printed packages in the depositing device.

Alternatively, the switch tongue can be controlled by means of a device for transposition.

A device for franking/printing images on packages according to the above method, having a feeder which receives the packages for processing and in which the packages are placed one on top of the other/beside each other, preferably guided on one side, and are each separated from the stack by a separation device and supplied to the conveyor line one behind the other in the conveying direction F, has been found to be particularly suitable for processing packages when the conveyor line of the conveying device which is connected to the franking machine in an actively conveying manner has a conveying portion having a switchable for guiding the packages on the conveyor line into the franking machine and in the opposite direction out of the franking machine, the printing mechanism of which has the switch tongue of a switch determining the conveying direction of the packages, so that a compact unit comprising the conveying device and the franking machine which can be operated as a separate franking machine by manually feeding the packages.

The device has been found to be particularly reliable if the switch tongue is constructed so as to be able to be lowered in order to guide the packages on the conveyor portion of the conveyor line extending transversely relative to the conveying direction and so as to be able to be raised in order to supply the depositing device (shelf) so that undisturbed transport of the packages to the franking machine and into the depositing device is achieved.

A simple embodiment has been found to be a switch tongue which is constructed so as to be able to be pivoted about a horizontal axle which is arranged transversely relative to the conveying direction F, particularly since, as a result of the desirably compact construction of the device, there is little space available for a mechanically and precisely functioning device.

It has been found to be effective and simple for the switch tongue to be constructed so as to be able to be independently adjusted by means of an irregular weight distribution on the axle (imbalance) in order to guide the packages on the conveyor line or the conveying portion and to afford/provide the conveying portion/conveyor line with the required stability.

It has been found to be efficient for the switch tongue to be controlled with the timing of the packages supplied on the conveyor line of the franking machine or with the timing of the printing franking machine so that a regularity is produced in the processing.

Advantageously, the redirection and adjustment of the switch tongue may be variable by means of a setting and adjustment screw which is arranged in a counter-weight of the switch tongue and which rises on a (fixed) stop and which enables/provides optimum adaptation of the switch to the partially different thickness of the packages on the conveying portion.

The conveying end of the conveyor line in front of the franking machine is preferably formed by means of two conveyor rollers which are perpendicular one above the other and which form a conveying gap and which provide a printing mechanism with packages and which remove the printed packages from the guiding shaft of the printing mechanism of the franking machine in an opposite direction and which can be controlled so as to rotate in a reversible manner about an axle which is arranged transversely relative to the conveying direction, and of which the lower roller is driven and controlled in a motorized manner and the upper roller is drivingly connected to the lower roller by means of friction.

There is provision for a free-standing, extension-arm-like guiding tongue of the switch tongue and a guiding plate which is arranged above the switch to form the conveying portion so that a conveying cross-section which is adapted to the thickness of the passing packages for optimal guiding thereof is produced.

The height of the conveying portion may be determined by the fixed stop for the counterweight of the switch tongue.

In order to promote the conveying efficiency on the conveyor line, the conveying end of the separation device may be formed by means of a conveyor roller pair of conveyor rollers which are arranged one above the other on the conveyor line and which form a changeable conveying gap which extends transversely relative to the conveying direction F and which is connected to the conveying portion which is formed by the switch in an actively conveying manner and which supports the reliability of the transport of the packages.

The construction of the device is suitable for the franking machine also not to require an upstream conveying device as a result of manually feeding the individual packages by the independent housings of the conveying device and franking machine which are constructed to be able to be separated from each other having housing openings which connect the conveyor line of the conveying device to the guiding shaft/printing shaft of the franking machine and which are connected to the conveying gap of the conveyor roller pair in an actively conveying manner so that a manual feeding of the individual packages is possible.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

FIGS. 1 to 4 show a device 1 in four method/processing steps for franking and/or printing images of packages 2 which are stacked one above the other in a feeder 3 of a separation device 4 before they leave the feeder.

Figure 1:
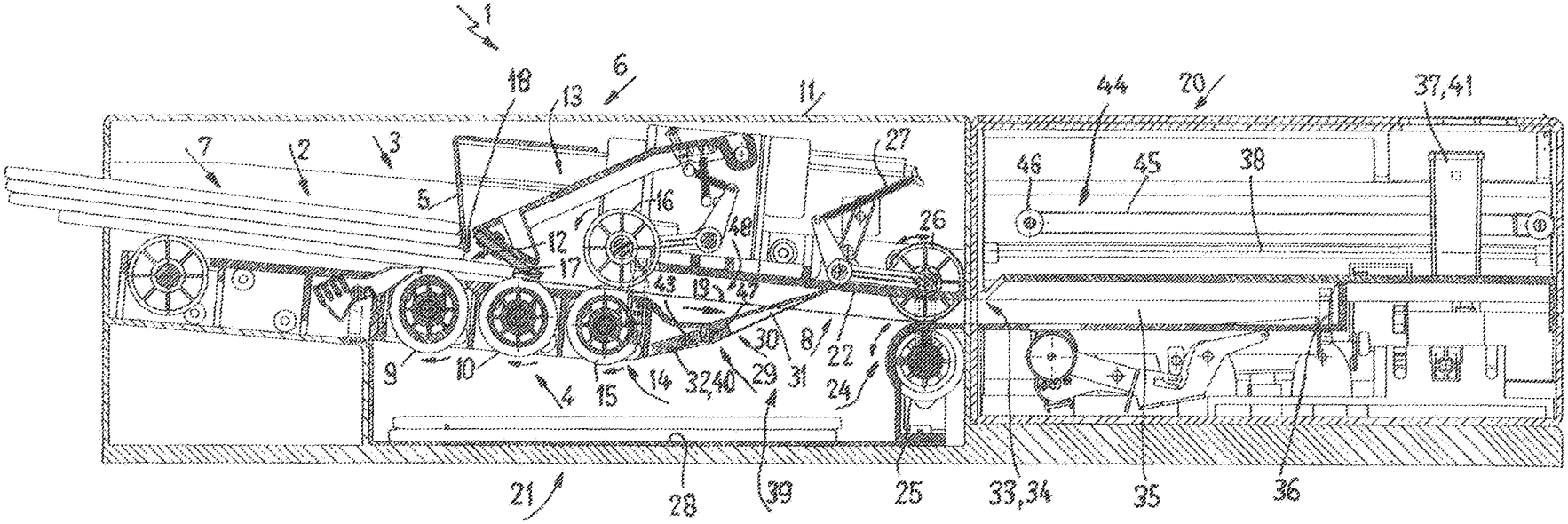
FIG. 1 shows a franking device of a conveyor line for further processing of a package which has been detected on a stack and which is intended to be supplied.

FIG. 1 illustrates the device 1 when the lowest package 2 of the four packages 2 which are stacked in the feeder 3 in an inclined manner in the conveying direction F is removed, of which the remaining three packages 2 are guided on a front edge on a stop face 5. The feeder 3 and separation device 4 form a separation station on the device 1 in which the packages 2 are each withdrawn/removed at the lower side of the stack 7 and transported further in the conveying direction F on an adjoining conveyor line 8, wherein the individual packages 2 of a stack 7 may have differing thickness dimensions and/or format sizes. The conveyor line 8 has at least in the region of the separation station 6 two transport rollers 9, 10 which form a conveying plane of the conveyor line 8 which is planar/slightly inclined in the conveying direction F and which carry the separated packages 2 and which are arranged one behind the other transversely relative to the conveying direction F and which are driven in the same direction. The transport rollers 9, 10 advantageously have the same diameter and the same peripheral speed. The transport rollers 9, 10 are supported at the lateral ends thereof in a housing 11 or frame of the device 1 and driven in a motorized manner.

The conveying plane formed by the transport rollers 9, 10 and the lower edge of the stop face 5 which terminates thereabove with spacing produce a discharge opening 12 which can be changed by means of the height adjustability of the stop face 5.

The packages 2 which are fed into the feeder 3 are detected on the conveyor roller 10 by means of an approach member 13 of the separation device 4 and the packages 2 which appear above the lowest package 2 are retained in the feeder 3 so that multiple removals are prevented.

As soon as the lowest package 2 is detected between the conveyor roller 10 and the approach member 13, it is transported further by the conveyor roller 9, 10 in the conveying plane in the conveying direction F and guided between the conveyor roller pair 14 which follows on the conveying plane and of which at least the lower conveyor roller 15 is driven, the upper conveyor roller 16 is located in a freely rotating and flexible manner on the lower roller 15 and forms therewith a frictionally engaging conveying gap.

The packages 2 reach the separation device 4 with the front edge in the transport direction F in each case orientated in a precisely positioned manner or in a uniform manner with the support of the stop face 5 of the feeder 3 which is inclined backward and which extends substantially over the width of the conveying plane.

The lower edge of the stop face 5 which forms the outlet opening 12 with the conveying plane 19 is constructed so as to be bent in the conveying direction F so that the outlet opening 12 remains undisturbed when the packages are transported. Furthermore, a feeding station of the present embodiment is described in EP 17 405 030 mentioned in the introduction.

FIG. 1 further illustrates the conveying plane 19 in the length of the conveyor line 8 which terminates in a franking machine 20. Between the separation station 6 or the end thereof and the franking machine 20 there is below the conveying plane 8/conveying plane 19 a space which acts as a depositing device 21 for the printed packages 2 which are returned by the franking machine 20. The depositing device 21 extends beyond the conveying plane 19 and is constructed by an upper guiding plate 22 which extends at the end of the separation station 6 or separation device 4 substantially parallel with the conveyor line 8 and at least approximately as far as the franking machine 20.

The opening of the conveyor line 8 in the franking machine 20 is formed by a conveyor roller pair 24 which is arranged one above the other so as to form a conveying gap which extends substantially horizontally and transversely relative to the conveying direction F, wherein the lower conveyor roller 25 is driven and the upper conveyor roller 26 which is supported thereon is supported so as to be able to be raised by means of resilient pressure (tension spring 27). The depositing device 21 which is located below the guiding plate 22 has a depositing base 28 for the printed packages 2 which arrive from the franking machine 20 and which are/become deposited one above the other.

There is arranged in a conveyor portion 48 of the conveyor line 8, with spacing above the depositing base 28 and below the guiding plate 22, a switch 29 which acts on the packages 2 and which ensures that, on the one hand, packages 2 which are intended for franking on the conveyor path between the separation device 4 or station 6 reach the franking machine 20 in an undisturbed state and, on the other hand, keep free the return path of the packages 2 which have been printed in the franking machine 20 in the depositing device below the switch 29.

The switch 29 which is illustrated in FIGS. 1 to 4 (rotation device) comprises a switch tongue 30 which can be pivoted about a substantially horizontal axle 47 which extends transversely relative to the conveying direction F and which as a result of a non-uniform weight distribution on the axle 47 can be independently pivoted upward, can preferably approach the guiding plate 22, so that with respect to a guiding tongue 31 which passes over the supplied packages 2 and the heavier counter-element 32 on the opposite side of the axle 47, there is produced an upwardly directed redirection effect against which the passing packages 2 act and thus use an auxiliary guiding means.

Of course, the switch tongue 30 could also be controlled so as to be (cyclically) driven in a motorized manner, in particular in order to process very thin packages 2 which have potentially inadequate rigidity for the lateral movement of the guiding tongue 31 of the switch tongue 30 away from the guiding plate 22 in order to form a conveying gap.

On the other hand, the upwardly rebounding switch tongue 30 is used for the packages 2 supplied to the depositing device 21 from the franking machine 20 or keeps the conveying path thereof leading into the depositing device 21 free. That is to say, the supplied packages 2 slide along or between the guiding plate 22 and the guiding tongue 31 or the conveyor line 8 between the conveyor rollers 25, 26 and are transported by them through a rear housing opening 33 into the franking machine 20, for which in the franking machine a housing opening 34 which is connected in an actively conveying manner is provided.

It is consequently possible to arrange upstream of a franking machine 20 a separation station 6/separation device 4 or to operate the franking machine 20 in a known manner by manually feeding individual packages 2.

The conveying speed of the packages 2 into the franking machine 20 at least substantially corresponds to the speed on the conveyor line traveled.

FIG. 1 shows two printed packages 2 located on the depositing base 28 of the depositing device 21.

The conveying end of the conveyor line 8 forms the printing position of a package 2 in the franking machine 20.

However, FIGS. 1 to 4 show for the most part a franking machine 20 which is composed/can be composed with a separation station 6 and a depositing device 21 for processing packages 2 which can be stacked in a feeder 3.

In FIG. 1, the franking machine 20 is illustrated in a substantially operation-free state (without a package). It is possible to see a substantially horizontal shaft 35 to which the packages 2 are each supplied individually in the conveying direction F as far as an end stop 36.

In this situation, the printing head 41 of a printing mechanism 37 which is guided on horizontal guide rails 38 is located in a rest or non-operational position of the printing mechanism 37, remote from the printing/franking position.

Figure 2:
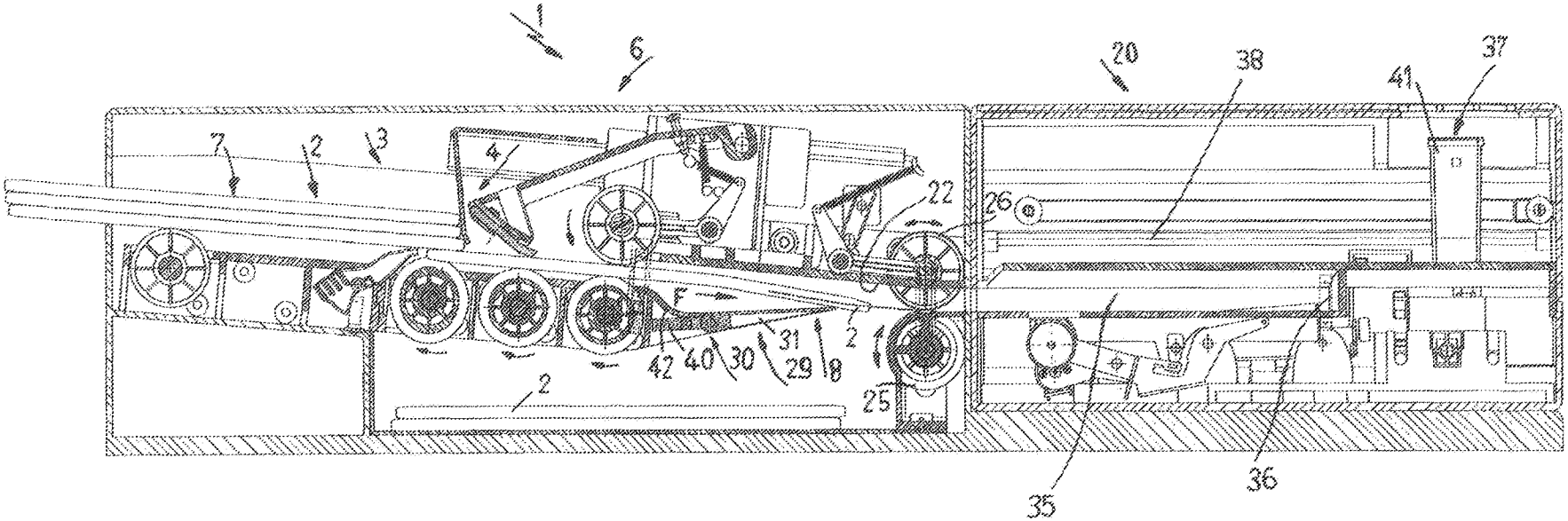
FIG. 2 shows the device according to FIG. 1 with a package removed from the stack.

FIG. 2 shows the device 1 in a processing situation in which the separated package 2 on the conveyor line 8 has reached the transfer region 39 between the separation device 4/separation station 6 and the franking machine 20. In this region, the package 2—as can be seen—is supported on the guiding tongue 31 of the switch tongue 30 so that it subsequently reaches the conveying gap formed by the conveyor rollers 25, 26 and is transported into the guiding shaft 35 which is intended for the franking and printing of images (see also FIG. 3).

FIG. 2 shows the lower position of the switch tongue 30 or the tip or the free end of the guiding tongue 31 which is brought about by the passing package 2. The lower position of the guiding tongue 31 is determined/delimited by the counterweight 40 which rests on/strikes a fixed stop 42, wherein the stop 42 is secured to the housing 11 of the separation device 4 or another available component. The position of the switch tongue 30 indicates that a discharge of the printed packages 2 from the franking machine 20 into the depositing device 21 is not advantageous, wherein the printing head continues to remain in the rest position of the franking machine 20.

In order to displace or adjust the guiding tongue 31 or the switch tongue 30, a setting and adjustment screw 43 can be mounted in the counter-weight 4 or in the stop 42 and is positioned so as to be able to be adjusted with the free end on the stop 42 or on the counterweight 40 so that the position of the guiding tongue 31 or the switch tongue 30 can be changed.

Figure 3:
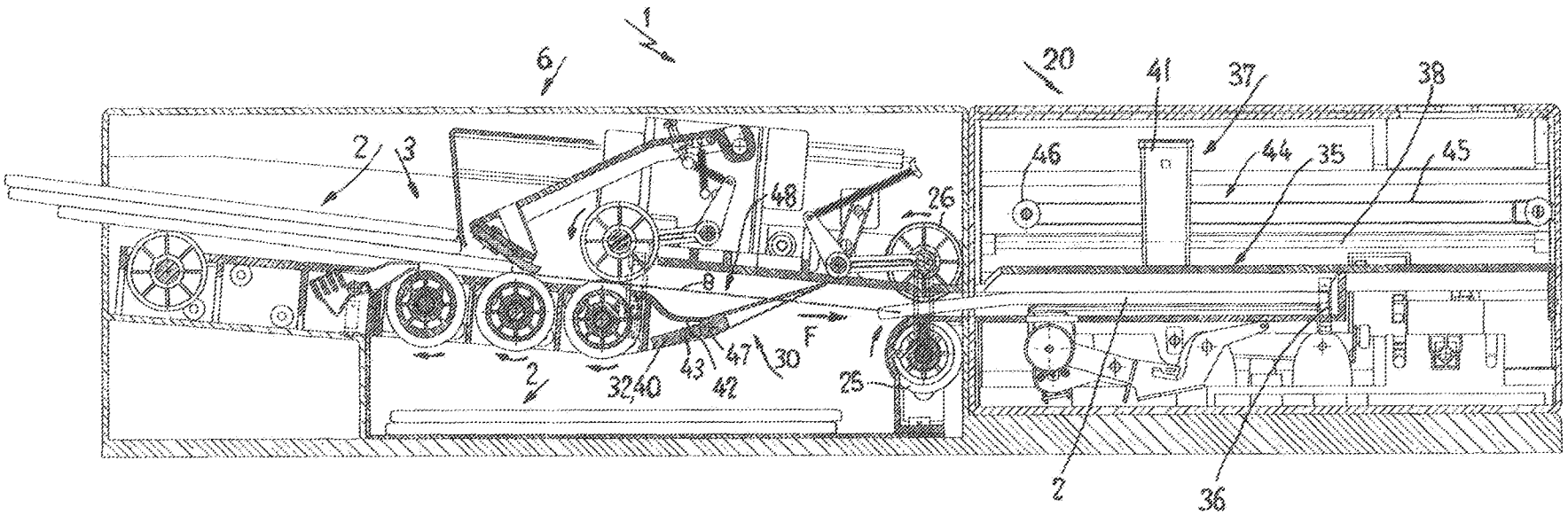
FIG. 3 shows the device according to FIGS. 1 and 2 with the package removed according to FIG. 2 in the printing mechanism of the franking machine in the printing position.

One method or processing step further on, according to FIG. 3 the package 2 which has been previously detected in FIG. 1 has reached the first destination, the guiding shaft 35 in the franking machine 20, the printing position, and the printing head 41 of the printing mechanism 37 is located in the operating position above the guiding shaft 35 or above the supplied package 2.

The printing head is released from the rest position into the operating position preferably before the package 2 strikes the end stop 36.

The package 2 remains securely held during the printing between the conveyor rollers 25, 26 which can be rotated in both directions, wherein the lower conveyor roller 25 can be rotated in both directions in order to transport the package 2 which has arrived in the conveying gap with the front edge into the guiding shaft 35 of the printing mechanism 37 and to remove it in the printed state from the shaft 35 or to place it in the depositing device 21. The preferably resiliently loaded applied upper conveyor roller 26 acts as a frictionally engaging connection for the application of the transport movement in the conveyor shaft 35.

The driving of the printing head 41 in the franking machine 20 is carried out via a traction drive 44 having an endless toothed belt 45 which runs around two redirection rollers 46 which are spaced apart from each other and to a strand of which the printing head 41 is drivingly connected.

Figure 4:
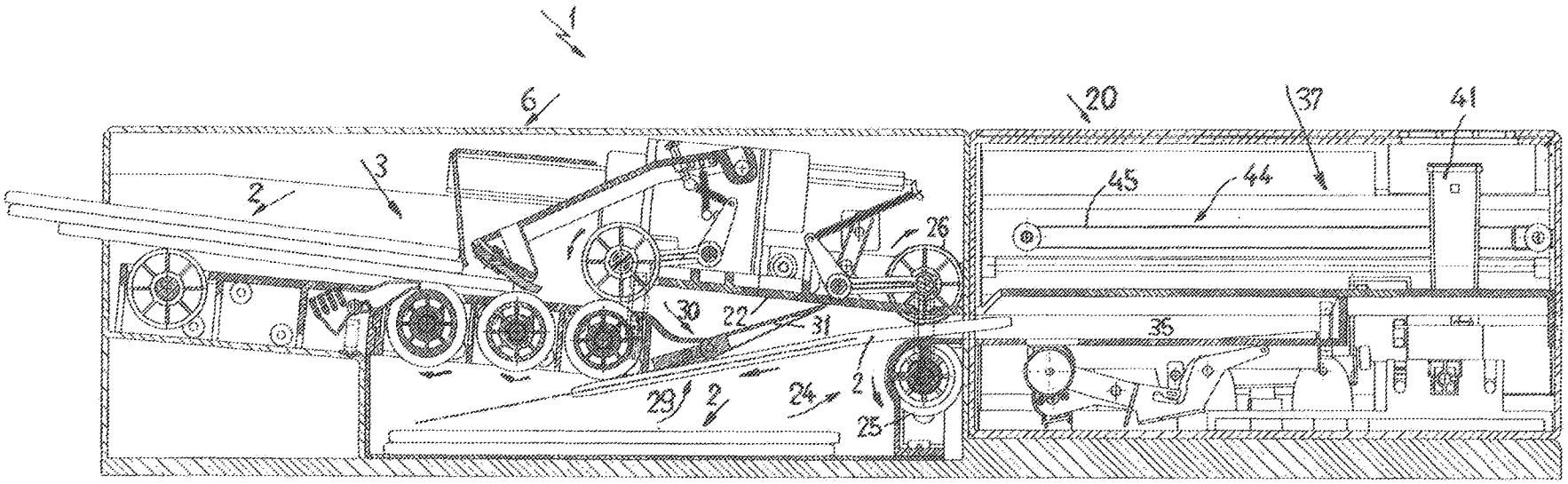
FIG. 4 shows the device according to FIGS. 1 to 3, in which the printed package has left the franking machine and in which the printing mechanism has been returned to the rest position after the printing.

FIG. 4 illustrates the transport of the package 2 which has originally been removed according to FIG. 1 from the feeder 3 during transport from the printing mechanism 37 of the franking machine 20. The printing head 37 has returned to the rest position again. The printed package 2 moves into the depositing device 21 in which two printed copies have already been placed one above the other. To this end, the guiding tongue 31 of the switch tongue 30 has risen upward via the counterweight 40 and abuts the guiding plate 22 without disturbing the trajectory of a printed package 2. The switch tongue 30 is, on the one hand, during the cyclical supply orientated by the packages 2 in accordance with the conveying gap of the conveyor roller pair 23 (see FIG. 2) and after cyclical interruption of the separation is returned upward to the feeder 3 in order to release the transport space in the depositing device 21.

While specific embodiments of the invention have been shown and described in detail to illustrate the inventive principles, it will be understood that the invention may be embodied otherwise without departing from such principles.

I claim:

1. A method for franking packages individually supplied from a stack on a conveyor line to a franking machine, comprising the steps of: removing the packages from a lower side of the stack for separation; supplying the separated packages on a conveyor portion of the conveyor line in a supply direction via a switch to a printing mechanism of the franking machine for franking; and after printing transposing the switch for discharging the packages from the franking machine counter to the supply direction to a depositing device arranged therebelow for the packages.

2. The method according to claim 1, including processing the packages in a cyclical manner.

3. The method according to claim 2, including carrying out actuation of the switch or supplying of the packages with timing of a printing sequence of the printing mechanism of the franking machine.

4. The method according to claim 2, including carrying out actuation of the switch or a printing sequence of the packages with timing of the separation of the packages.

5. A device for franking/printing images on packages that are individually removed at a lower side/front side of a stack, comprising: a franking machine; a conveyor line for conducting the packages to the franking machine; a depositing device into which the printed packages are discharged from the franking machine; a feeder that receives the packages and in which the packages are placed on top of one another/next to each other in a stack; and a separation device that separates the packages from the stack and supplies the separated packages to the conveyor line one behind the other in a conveying direction, wherein the conveyor line is connected to the franking machine in an actively conveying manner and has a conveyor portion with a switch having a switchable switch tongue that determines the conveying direction of the packages, the switch tongue being constructed to guide the packages on the conveyor line into the franking machine and in an opposite direction out of the franking machine into the depositing device.

6. The device according to claim 5, wherein the switch tongue is constructed so as to be able to be lowered in order to guide the packages on the conveyor line transversely relative to the conveying direction and so as to be able to be raised in order to supply the depositing device.

7. The device according to claim 6, wherein the switch tongue has a counterweight, a setting and adjustment screw being arranged in the counterweight so as to engage a stop so that excursion of the switch tongue is changeable by the setting and adjustment screw.

8. The device according to claim 5, wherein the switch tongue is constructed so as to be able to be pivoted about an axle arranged transversely to the conveying direction.

9. The device according to claim 8, wherein the switch tongue is constructed so as to be able to be independently adjusted by an irregular weight distribution on the axle so as to guide the packages on the conveyor line.

10. The device according to claim 8, wherein the switch tongue includes a guiding tongue, the device further comprising a guiding plate arranged above the switch so that the guiding tongue and the guiding plate form the conveyor portion.

11. The device according to claim 5, wherein the switch tongue is motor-driven.

12. The device according to claim 5, wherein the switch tongue is controlled with a timing of the packages that are supplied on the conveyor line of the franking machine or with a timing of the franking machine.

13. The device according to claim 5, wherein the franking machine has a printing mechanism with a guide shaft, wherein the conveyor line has a conveying end with two conveyor rollers substantially perpendicular above one another so as to form a conveying gap, the rollers being operative to supply the printing mechanism of the franking machine with packages and to remove printed packages from the guide shaft of the printing mechanism in the opposite direction, the rollers being controllable so as to rotate in a reversible manner about axes that are arranged transversely relative to the conveying direction.

14. The device according to claim 13, wherein the conveyor line and the franking machine have housings constructed so as to be separable from each other, the housings having openings that connect the conveyor line to the guide shaft and that are connected to the conveying gap of the conveyor roller pair in an actively conveying manner.

15. The device according to claim 5, wherein the separation device has a conveyor end formed by a conveyor roller pair arranged on the conveyor line, the conveyor roller pair comprising conveyor rollers arranged above one another so as to form a changeable conveyor gap that extends transversely to the conveying direction and is connected to the conveyor portion formed by the switch in an actively conveying manner.

* * * * *